US006105913A

United States Patent [19]

Couture

[11] Patent Number: 6,105,913

[45] Date of Patent: Aug. 22, 2000

[54] ADJUSTABLE SUPPORT ASSEMBLY

[75] Inventor: Normand Couture, Piedmont, Canada

[73] Assignee: Shermag Inc., Quebec, Canada

[21] Appl. No.: 09/217,656

[22] Filed: Dec. 21, 1998

[51] Int. Cl.[7] ..... E04G 3/00

[52] U.S. Cl. ..... 248/274.1; 248/283.1

[58] Field of Search ..... 248/283.1, 539, 248/514, 274.1, 669; 403/103, 99, 97, 84, 383; 297/283.1, 353, 440.16, 463.1, 463.2, 411.35

[56] References Cited

U.S. PATENT DOCUMENTS

| | | | |
|---|---|---|---|
| 1,059,856 | 4/1913 | Fox | 248/669 |
| 2,466,204 | 4/1949 | Brown | 297/115 |
| 2,663,359 | 12/1953 | Wood | 297/253 |
| 3,304,035 | 2/1967 | Davis | 248/516 |
| 4,920,897 | 5/1990 | Reed et al. | 108/150 |
| 5,499,644 | 3/1996 | Geniele | 135/20.1 |
| 5,606,918 | 3/1997 | Cauffiel | 108/42 |
| 5,730,688 | 3/1998 | Prusick | 482/130 |

*Primary Examiner*—Derek J. Berger
*Assistant Examiner*—David Heisey
*Attorney, Agent, or Firm*—Collard & Roe, P.C.

[57] ABSTRACT

The adjustable support assembly is for supporting a component of a piece of furniture, such as a backrest or armrest of a sofa. The component is fixed to the upper end of a shaft. The lower end of the shaft is insertable into an elongated hollow member, fixed to the frame of the sofa with a mounting bracket connected to the hollow member and screwed to the frame. A locking device releasably holds the shaft in any one of a plurality of angular positions with respect to the hollow member when the shaft is substantially engaged in the hollow member. The orientation of the component may therefor be easily adjusted and locked when a person sitting on the sofa so desires.

20 Claims, 5 Drawing Sheets

ADJUSTABLE SUPPORT ASSEMBLY

FIELD OF THE INVENTION

The present invention relates to an adjustable support assembly for supporting a component, such as a backrest or an armrest, upon a structural part of a sofa or other piece of furniture.

BACKGROUND

Sofas are usually composed of a frame provided with cushions and various projecting components such as backrests and armrests. In the most common sofas' design, these components are rigidly attached to the frame.

It is also known in the art to provide a sofa with removable and interchangeable backrests and armrests. These components are for example provided with a downwardly projecting shaft removably inserted into a hole made in the frame or in a support bracket added to the frame for this purpose. However, the components can be installed in only one specific orientation, or otherwise are free to rotate about the axis of the shaft. Neither of these alternatives allow a person sitting on the sofa to releasably lock the angular position of the component so he may rest on it in any desired direction.

OBJECTS AND SUMMARY OF THE INVENTION

Accordingly, an object of the present invention is to provide a support assembly for a component of a sofa or other piece of furniture, in which the orientation of the component can be adjusted and locked in a plurality of angular positions.

Another object of the present invention is to provide such a support assembly which is simple to use and inexpensive to manufacture.

Yet another object of the present invention is to provide such a support assembly which may be hidden from view so as to preserve the aesthetic qualities of the sofa.

In accordance with the above objects, the present invention provides an adjustable support assembly for supporting a component upon a structural part of a piece of furniture. This adjustable support assembly comprises a shaft having an upper end and a lower end, the upper end being arranged to support the component. An elongated hollow member has an opening for receiving the lower end of the shaft in a sliding engagement. Fastening means are provided for fastening the elongated hollow member to the structural part. Locking means are provided for releasably holding the shaft in any one of a plurality of angular positions with respect to the hollow member when said shaft is substantially engaged in said hollow member.

Preferably, the fastening means is in the form of a mounting bracket on one side of the hollow member and shaped to fit against the structural member of the sofa.

Preferably, the locking means comprises a catch at the bottom of or inside the hollow member, the catch having circumferentially distributed dents so that the lower end of the shaft fits into the catch only when in specific angular positions.

BRIEF DESCRIPTION OF THE DRAWINGS

The present invention and its advantages will be better understood upon reading the following non restrictive description of preferred embodiments thereof, with reference to the following drawings.

DESCRIPTION OF PREFERRED EMBODIMENTS OF THE INVENTION

In the preferred embodiments described herein, the adjustable support assembly according to the present invention is described as used for supporting components of a sofa, such as backrests, armrests, or a side table. It is however to be understood that the present invention may be equally used with other pieces of furniture such as a chair or a bed and any other component that may complement such structures.

Figure 1:
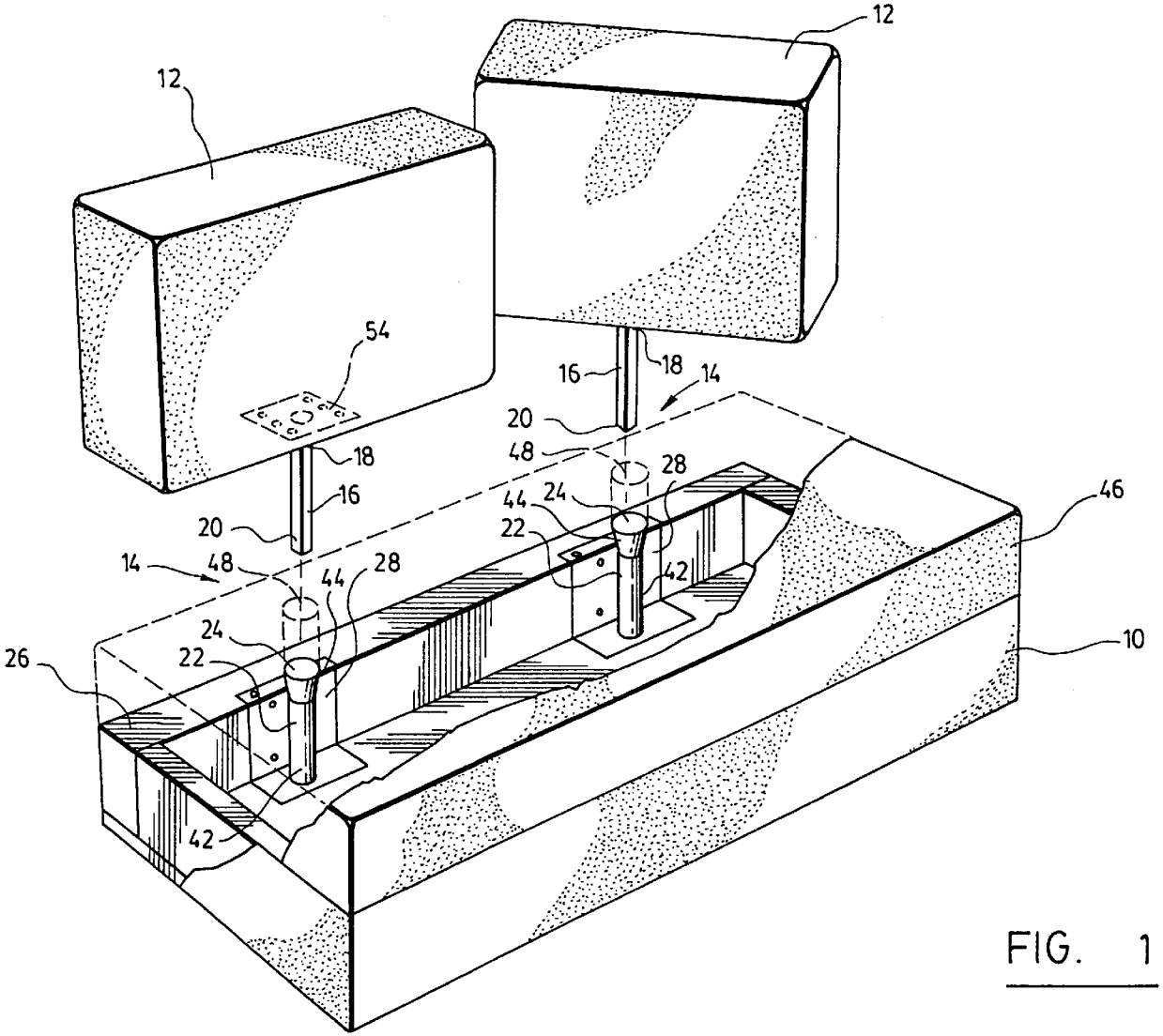
FIG. 1 is a perspective, exploded view of a sofa having two backrests mounted with support assemblies according to the present invention.

Referring to FIG. 1 there is shown a sofa (10) provided with two backrests (12), each being mounted with a support assembly (14) according to a first embodiment of the present invention.

Figure 2:
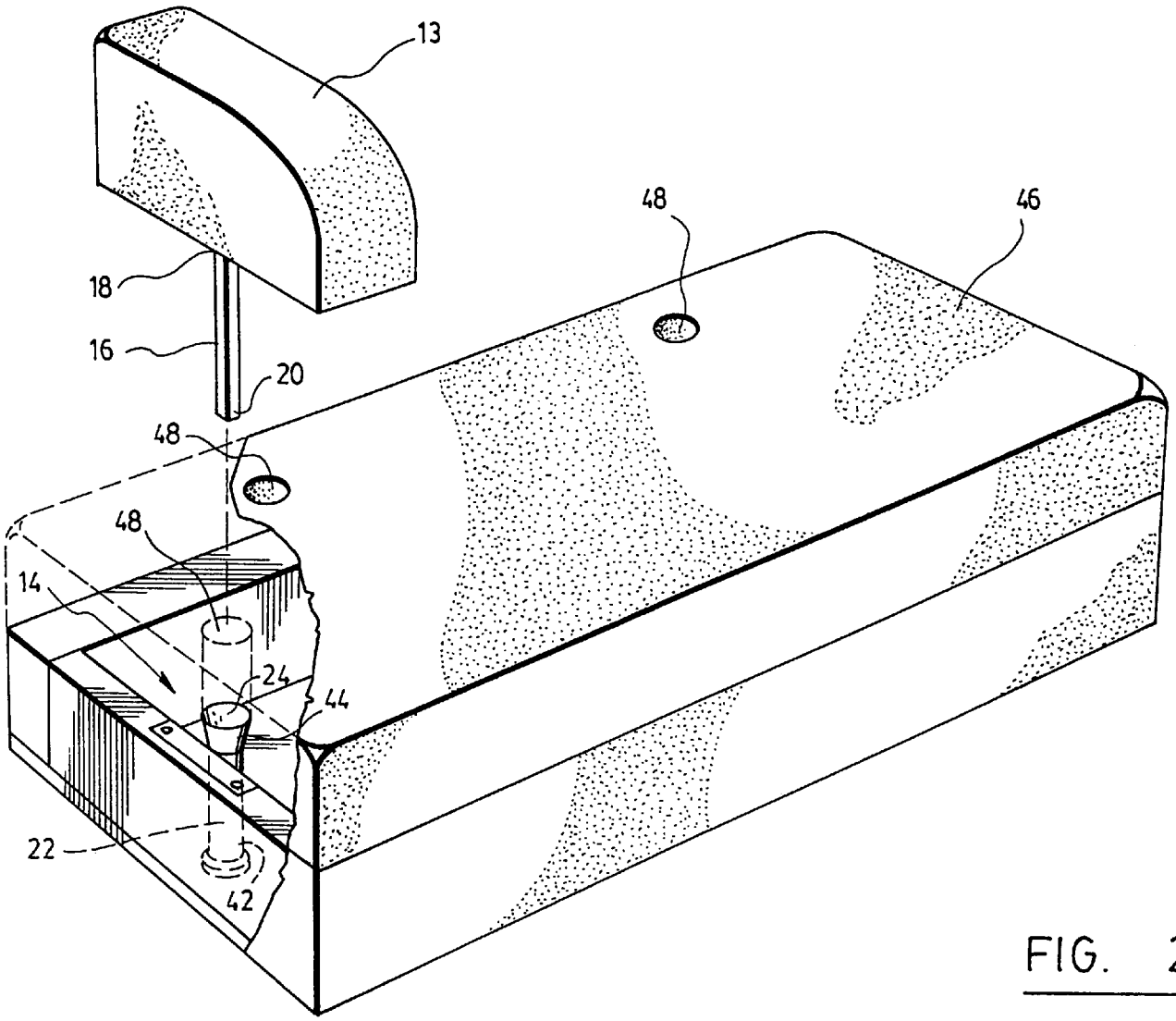
FIG. 2 is a perspective, exploded view of a sofa having an armrest mounted with a support assembly according to the present invention.
Figure 4:
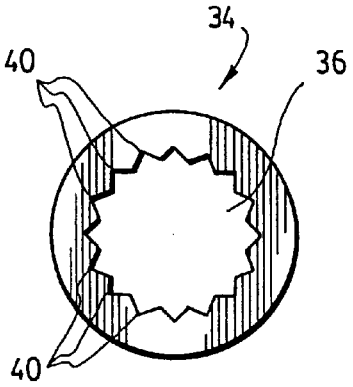
FIG. 4 is a bottom view of a support assembly according to the present invention, without the mounting bracket.

Referring to FIG. 2 there is shown a similar sofa, having an armrest (13) mounted with a support assembly (14) having a slightly different design from the support assemblies shown in FIG. 1.

Referring to both FIGS. 1 and 2, each support assembly (14) includes a shaft (16) having upper and lower ends (18, 20). The upper end (18) is adapted to support the desired component, embodied in the present cases by the backrests (12) or the armrest (13). The upper end (18) of the shaft (16) can be provided with a mounting plate (54), to receive the component thereon. Each support assembly (14) further includes an elongated hollow member (22) having an opening (24) extending preferably along its length. This opening (24) is fit to receive the lower end (20) of the shaft (16) in a sliding engagement. For a sofa (10) having a seat cushion (46) covering the frame (26), vertical holes (48) are preferably made therein, in alignment with the opening (24) of the elongated hollow member (28). Preferably, the elongated hollow member (22) has a tubular shaped lower portion (42) and a flare-shaped upper portion (44). In this manner, the lower end (20) of the shaft (16) may be inserted easily into the holes (48) and guided by the flare-shaped upper portion (44) into the tubular portion (42).

Figure 3:
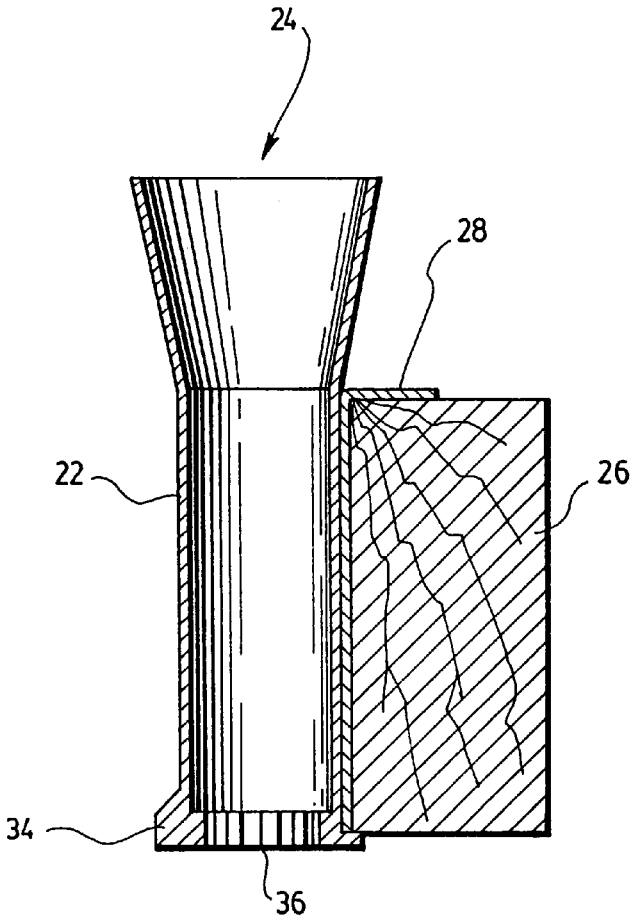
FIG. 3 is a side view of a support assembly according to the present invention, without the shaft and the component.
Figure 6:
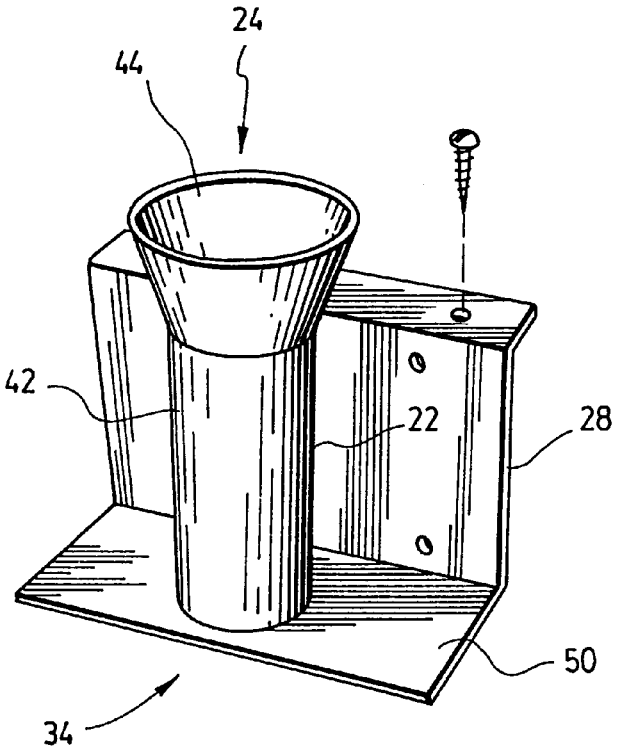
FIG. 6 is a perspective view of the hollow member and the mounting bracket of the support assembly shown in FIG. 1.
Figure 7:
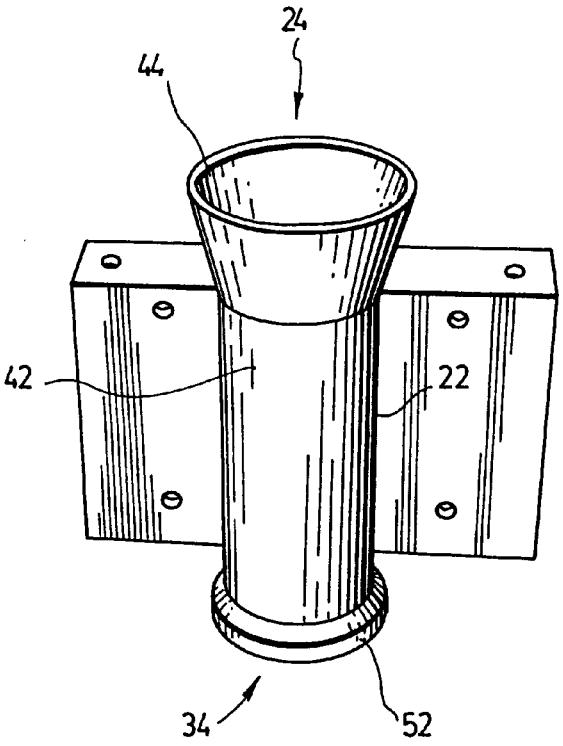
FIG. 7 is a perspective view of the hollow member and mounting bracket of the support assembly shown in FIG. 2.

As may be seen in FIGS. 3, 6 and 7, the elongated hollow member (22) is fastened to a structural part of the sofa, such as its frame (26). A mounting bracket 28 is preferably used for this purpose. The bracket (28) is connected to a side of the hollow member (22). These two elements may for example be made of metal and be welded together. The bracket (28) shown in the figures is L-shaped. Other shapes may be used as needed. The bracket (28) may be screwed on the frame (26) of the sofa (10) with screws (32) inserted through holes (30) made in the bracket (28). Other types of fasteners can be used if desired.

Referring now to FIGS. 3, 4, 5A and 5B, the adjustable support assembly (14) according to the present invention further includes a locking device for the purpose of releasably holding the shaft (16) in any one of a plurality of angular positions with respect to the hollow member (22), when the shaft (16) is substantially engaged therein. The locking device preferably comprises a catch (34), affixed to the hollow member (22) and preferably located conveniently at the bottom thereof. The catch (34) has an opening (36), in alignment with the opening (24) of the hollow member (22). The opening (36) is shaped so that the lower end (20) of the shaft (16) fits therein only when in the desired angular positions. In this embodiment, the lower end (20) of the shaft (16) has a non-circular cross section to be engageable with the catch (34) in the different angular positions.

Figure 5A:
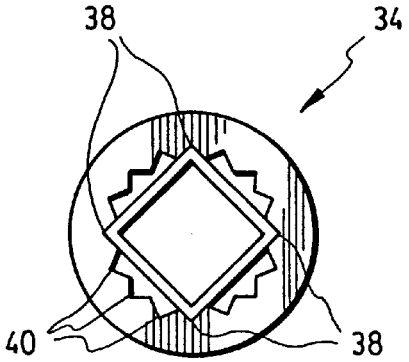
FIGS. 5A and 5B are bottom views of a support assembly according to the present invention, respectively showing the shaft inserted into the elongated hollow member in a first and a second angular position.
Figure 5B:
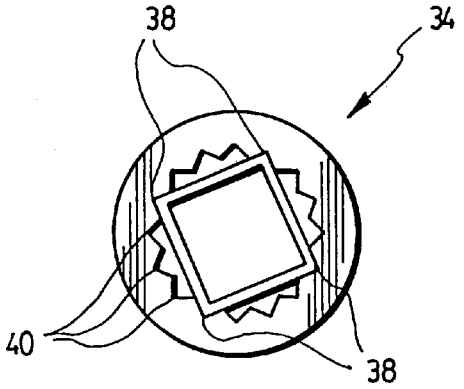

The locking engagement described above may be achieved in a plurality of manners. In the embodiment illustrated herein, the shaft (16) is provided with a projection (38) extending along its length. The opening (36) of the catch (34) has circumferentially distributed dents (40), best seen in FIG. 4, in which the projection (38) of the shaft (16) is insertable. The shaft (16) may conveniently have a rectangular or square cross-section, having four corners each defining a projection (38). FIGS. 5A and 5B show such an embodiment where the lower end (20) of the shaft (16) is engaged in the dents (40) of the catch (34) in two different angular positions.

Advantageously, the present embodiment makes the support assembly according to the invention very easy to operate. To change the orientation of the component, the user simply has to partially lift up the component, thereby disengaging the lower end (20) of the shaft (16) from the catch (34), then rotating the component, and sliding it down to engage the lower end (20) of the shaft (16) with the catch (34) in the new desired angular position. It may be necessary to slightly wiggle the component to orient the shaft in one of the angular positions provided by the catch.

The catch (34) may be given a variety of shapes and be attached to the hollow member (22) in any appropriate manners.

FIGS. 6 and 7 show two preferred embodiments of the catch (34). As shown in FIG. 6, the bracket (28) may be step-shaped and include a lower ledge (50) extending under the hollow member (22). The dents (40) may be provided in this lower ledge (50), which in this case acts as the catch (34). Alternatively, in the preferred embodiment of FIG. 7, the catch (34) has a ring-shaped outer portion (52) and is fixed directly under the hollow member (22).

Figure 8:
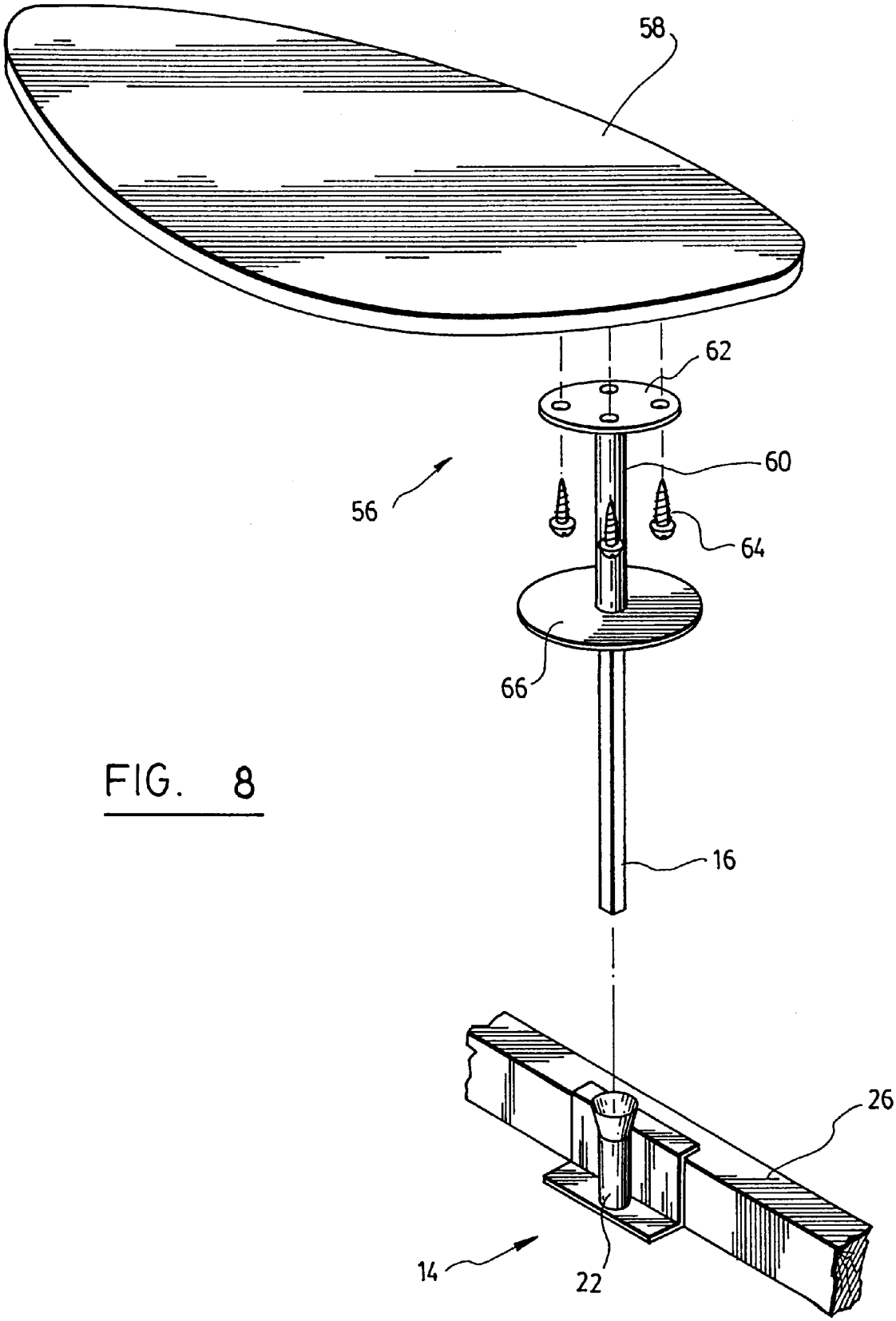
FIG. 8 is an exploded view of an adjustable support assembly for a table, according to an embodiment of the present invention.

Referring now to FIG. 8, there is shown another preferred embodiment of the invention where the component is a side table (56). The side table (56) preferably has a table surface (58), and a table arm (60) projecting downwardly therefrom. A table mounting plate (62) may be provided on the upper end of the table arm (60), the table surface (58) being fixed to this table mounting plate (62) with screws (64). Preferably, a stopping plate (66) may also be provided extending on the upper end (18) of the shaft (16), to rest on the sofa (10) when the shaft (16) is engaged in the hollow member (22). In this manner, the table surface (58) extends at a predetermined convenient height over the sofa (10).

While embodiments of this invention have been illustrated in the accompanying drawings and described above, it will be evident to those skilled in the art that changes and modifications may be made therein without departing from the essence of this invention. All such modifications or variations are believed to be within the scope of the invention as defined by the claims appended hereto.

What is claimed is:

1. An adjustable support assembly for supporting a component upon a structural part of a piece of furniture, comprising:

a shaft having an upper end and a lower end, the upper end being arranged to support the component and the lower end having a non-circular cross-section;

an elongated hollow member having a flare-shaped upper portion and an opening for receiving the lower end of the shaft in a sliding engagement;

means for fastening the elongated hollow member to the structural part; and locking means for releasably holding the shaft in any one of a plurality of operative angular positions with respect to the hollow member when said shaft is substantially engaged in said hollow member, said locking means comprising a catch affixed to the hollow member, the catch having an opening in alignment with the opening of the hollow member and being shaped so that the lower end of the shaft fits in the opening of the catch only when in said angular positions, said catch being affixed to hollow member at a position lower than the flare-shaped upper portion so that the angular position of the shaft is changeable by partly raising said shaft without disengaging said shaft from the hollow member.

2. The adjustable support assembly according to claim 1, wherein:

the shaft has a given length and a projection extending along said length; and the opening of the catch has circumferentially distributed dents in which the projection of the shaft is insertable.

3. The adjustable support assembly according to claim 2, wherein the shaft has a rectangular cross-section with four corners providing said projection and three additional projections also insertable in said dents.

4. The adjustable support assembly according to claim 3, wherein the rectangular cross-section of the shaft is squared.

5. The adjustable support assembly according to claim 1, wherein the catch has a ring-shaped outer portion.

6. The adjustable support assembly according to claim 1, wherein the catch is at a bottom of the hollow member.

7. The adjustable support assembly according to claim 1, wherein the elongated hollow member has a tubular shape.

8. The adjustable support assembly according to claim 1, wherein the means for fastening comprise a bracket connected to a side of the elongated hollow member.

9. The adjustable support assembly according to claim 8 wherein the bracket has through holes and the means for fastening further include screws insertable in said through holes.

10. The adjustable support assembly according to claim 8, wherein said bracket has an L-shape.

11. The adjustable support assembly according to claim 8, wherein the bracket has a step shape including a lower ledge extending under the hollow member.

12. The adjustable support assembly according to claim 8, wherein the elongated hollow member and the bracket are made of metal, and said bracket is welded to said elongated hollow member.

13. The adjustable support assembly according to claim 1, further comprising a mounting plate extending on the upper end of the shaft.

14. An adjustable support assembly in combination with a structural part of a piece of furniture, said support assembly supporting a component on said structural part, comprising:

a shaft having an upper end and a lower end, the upper end being arranged to support the component and the lower end having a non-circular cross-section;

an elongated hollow member having a flare-shaped upper portion and an opening for receiving the lower end of the shaft in a sliding engagement;

means for fastening the elongated hollow member to the structural part; and locking means for releasably holding the shaft in any one of a plurality of operative angular positions with respect to the hollow member when said shaft is substantially engaged in said hollow member, said locking means comprising a catch affixed to the hollow member at a position lower than the flare-shaped upper portion, the catch having an opening in alignment with the opening of the hollow member and being shaped so that the lower end of the shaft fits in the opening of the catch only when in said angular positions, said catch being affixed to hollow member at a position lower than the flare-shaped upper portion so that the angular position of the shaft is changeable by partly raising said shaft without disengaging said shaft from the hollow member.

15. The adjustable support assembly combination according to claim 14, where the piece of furniture is a sofa.

16. The adjustable support assembly combination according to claim 15, where the component is a backrest or an armrest.

17. The adjustable support assembly combination according to claim 16, wherein:

the shaft has a given length and a rectangular cross-section with four corners each defining a projection along said length;

the elongated hollow member has a tubular lower portion and a flare-shaped upper portion;

the locking means comprise a catch affixed to a bottom of the hollow member and having an opening in alignment with the opening of said hollow member, said opening of the catch having circonferentially distributed dents in which the projections of the shaft are insertable, the lower end of the shaft thereby fitting in the opening of the catch only when in said angular positions; and the means for fastening the elongated hollow member comprise an L-shaped bracket connected to a side of said hollow member and having through holes therein, the means for fastening further comprising screws insertable in said through holes.

18. The adjustable support assembly combination according to claim 14, where the component is a side table.

19. The adjustable support assembly combination according to claim 18, wherein the side table comprises:

a table surface; and a table arm downwardly projecting from said table surface, said table arm being connected to the upper end of the shaft.

20. The adjustable support assembly combination according to claim 19, further comprising a stopping plate extending on the upper end of the shaft and resting on the structural part when said shaft is substantially engaged in the elongated hollow member.

* * * * *